United States Patent [19]

Paget

[11] Patent Number: 4,457,680

[45] Date of Patent: Jul. 3, 1984

[54] ROTARY COMPRESSOR

[76] Inventor: Win W. Paget, P.O. Box 1335, Elizabethtown, N.C. 28337

[21] Appl. No.: 489,045

[22] Filed: Apr. 27, 1983

[51] Int. Cl.[3] ..... F04C 1/24; F01C 1/24

[52] U.S. Cl. ..... 418/191; 418/227

[58] Field of Search ..... 418/191, 196, 199, 225, 418/227

[56] References Cited

U.S. PATENT DOCUMENTS

| | | | |
|---|---|---|---|
| 3,787,154 | 1/1974 | Edstrom | 418/201 |
| 3,910,731 | 10/1975 | Persson | 418/201 |
| 4,086,880 | 5/1978 | Bates | 418/191 |
| 4,224,016 | 9/1980 | Brown | 418/191 |

FOREIGN PATENT DOCUMENTS

| | | | |
|---|---|---|---|
| 1126121 | 1/1967 | U.S.S.R. | 418/191 |

*Primary Examiner*—Leonard E. Smith
*Assistant Examiner*—Jane E. Obee
*Attorney, Agent, or Firm*—Young & Thompson

[57] ABSTRACT

A rotary compressor of the type in which a female rotor and a male rotor turn in opposite directions in the compressor casing, the female rotor having at least one pocket therein that receives at least one lobe on the male rotor, the lobe sweeping a cylindrical side wall of the casing to effect compression of a gas. A sealing rib is provided on the female rotor on the trailing side of the pocket, and a recess is provided on the male rotor at the rear of the lobe for receiving this rib. The female rotor has a peripheral surface extending rearwardly from the rib with respect to the direction of rotation of the female rotor, and terminating in the same or a different pocket, this peripheral surface being spaced a substantial distance radially inwardly of the surrounding cylindrical side wall of the casing, the rib sweeping this side wall with close clearance and hence effecting a portion of the compression of the compressor. The male rotor likewise has a peripheral surface spaced radially inwardly from its associated cylindrical side wall of the casing and extending from the recess in the male rotor rearwardly with respect to the direction of rotation of the male rotor to the same or a different lobe. These two peripheral surfaces, when juxtaposed, are spaced with only a small clearance thereby to seal between the rotors. The peripheral extent of these peripheral surfaces is substantially greater than that of their respective rib and recess, that on the female rotor being at least four times the peripheral extent of the rib.

3 Claims, 8 Drawing Figures

ROTARY COMPRESSOR

The present invention relates to rotary compressors, more particularly of the type in which a female rotor and a male rotor turn in opposite directions in the compressor casing, the female rotor having at least one pocket therein that receives at least one lobe on the male rotor, the looe sweeping a cylindrical side wall of the casing to effect compression of a gas.

In such compressors, the lobe on the male rotor defines the rear of a compression chamber whose volume decreases as the male rotor rotates, the gas in this compression chamber rising correspondingly in pressure.

However, subsequent to this substantial pressure rise, the pocket in the female rotor comes into communication with this compressed gas. The gas in the pocket has not undergone a corresponding compression and so is at a much lower pressure. The result is that the compressed gas forward of the lobe expands into the pocket, with an increase in entropy and a corresponding loss of work. The efficiency of the compressor is correspondingly reduced.

It is accordingly an object of the present invention to prevent this sudden drop in pressure of the compressed gas upon communication with a pocket in the female rotor.

Another object of the present invention is the provision of a rotary compressor in which the pocket in the female rotor remains in communication with the space forwardly of the lobe of the male rotor, and hence remains at substantially the same pressure as that space, throughout the compression cycle.

Briefly, the present invention achieves these objects by providing a rotary compressor of the type described, in which a sealing rib is provided on the female rotor on the trailing side of the pocket, and a recess is provided on the male rotor at the rear of the lobe for receiving this rib. The female rotor has a peripheral surface extending rearwardly from the rib with respect to the direction of rotation of the female rotor, and terminating in the same or a different pocket, this peripheral surface being spaced a substantial distance radially inwardly of the surrounding cylindrical side wall of the casing, the rib sweeping this side wall with close clearance and hence effecting a portion of the compression of the compressor. The male rotor likewise has a peripheral surface spaced radially inwardly from its associated cylindrical side wall of the casing and extending from the recess in the male rotor rearwardly with respect to the direction of rotation of the male rotor to the same or a different lobe. These two peripheral surfaces, when juxtaposed, are spaced with only a small clearance thereby to seal between the rotors. The peripheral extent of these peripheral surfaces is substantially greater than that of their respective rib and recess, that on the female rotor being at least four times the peripheral extent of the rib.

These and other objects, features and advantages of the present invention will become apparent from a consideration of the following description, taken in connection with the accompanying drawings, in which.

Figure 2:
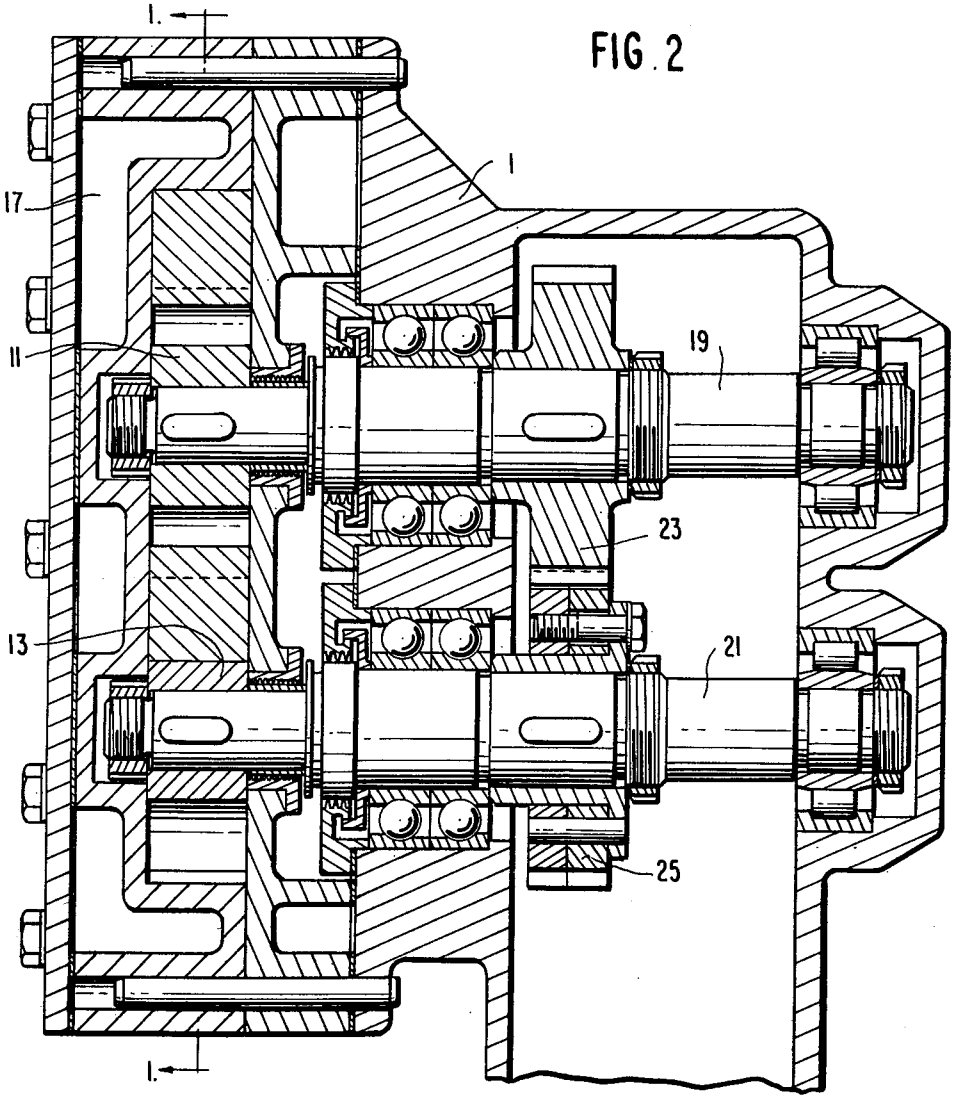
FIG. 2 is a cross-sectional view thereof on the line 2—2 of FIG. 1.
Figure 1:
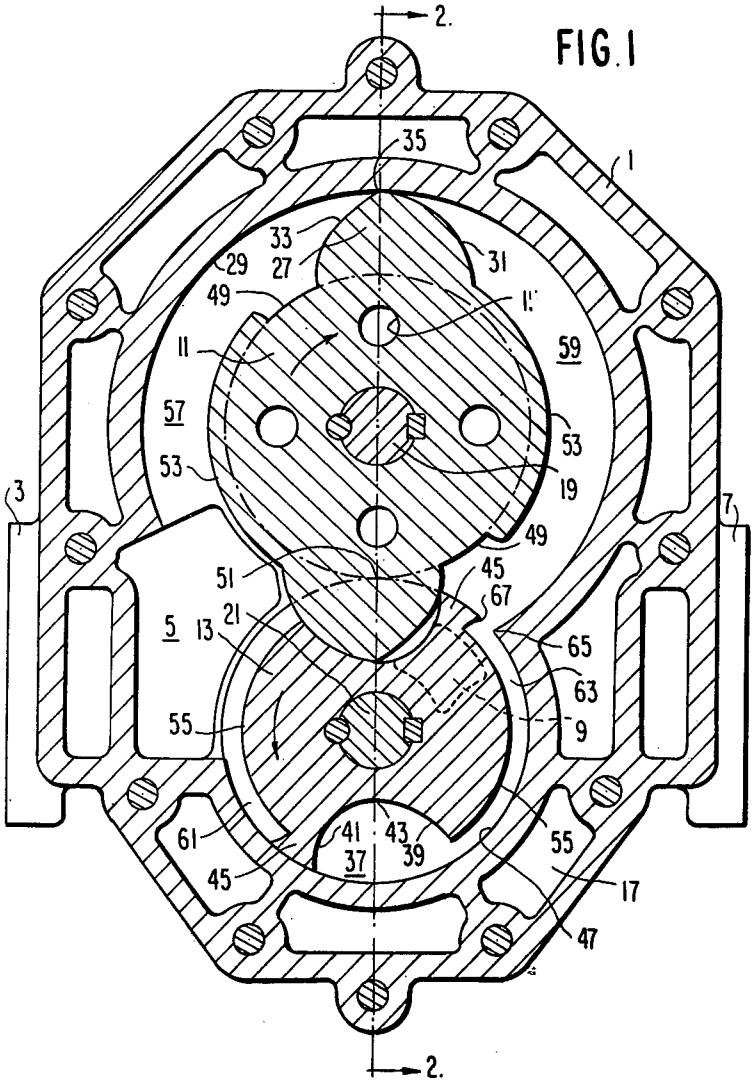
FIG. 1 is a cross-sectional view on the line 1—1 of FIG. 2, of a rotary compressor according to the present invention.

Referring now to the drawings in greater detail, and first to FIGS. 1 and 2 thereof, there is shown a rotary compressor according to the present invention, comprising a casing 1 having an inlet flange 3 adapted to be secured to a source of the gas to be compressed, e.g. air, communicating with an inlet port 5 that communicates with the suction side of the compressor. At the other side of casing 1 is an outlet flange 7 adapted to be connected to a receiver for the compressed gas, communicating with at least outlet port 9 on the compression side.

Disposed within the casing is a pair of rotors comprising a male rotor 11 and a female rotor 13. Rotor 11 has holes 15 therethrough for the equalization of pressure on opposite sides of the rotor. Preferably, two outlet ports 9 are provided on opposite sides of female rotor 13.

The compressor of the present invention is of the non-lubricated type and so the rotors have slight clearance with the side walls of the casing and with each other.

In order to prevent thermal distortion of the casing relative to the rotors, casing 1 is of webbed and double walled construction, with a series of cooling liquid pockets 17 therein which communicate with each other and through which flows a coolant liquid from a source thereof (not shown). The purpose of the liquid flow is more to maintain a uniform temperature throughout the casing than to eliminate heat of compression.

The rotors 11 and 13 are carried by shafts 19 and 21 that are mounted for rotation in suitable bearings in casing 1. As was pointed out above, rotors 11 and 13 never touch each other; and so, to maintain the required precise angular relationship between the rotors, shafts 19 and 21 are provided with interengaging timing gears 23 and 25, respectively. Gear 25 is adjustable in known fashion, to allow a slight radial shift to correctly space the rotors and a slight shift in angularity to eliminate play. However, this is a conventional arrangement and so need not be described in greater detail. As is also conventional, drive gearing (not shown) engages with gear 23 to drive the compressor.

As thus far described, the structure and arrangement of the compressor can be entirely conventional.

The unobvious subject matter of the present invention resides in the rotor configuration and the interaction of the rotors with each other and with the casing, which configuration and interaction are as follows:

Male rotor 11 is provided with at least one and preferably two lobes 27 that extend outwardly almost but not quite into contact with cylindrical side wall 29 of casing 1. Rotors 11 and 13 are not of the helical type but rather are of constant cross-sectional configuration. In other words, the generatrices of the rotors remain parallel to the rotor axes at all times. Therefore, the description of one cross section of the rotors suffices for all.

In the case of a two-lobe male rotor 11 as shown, the lobes 27 are identical in configuration and diametrically opposite each other. Each lobe 27 has a convex leading side 31 and a convex trailing side 33, whose particular configurations are important to the invention and which will be discussed in detail hereinafter. Each has a crest 35 which is a straight line which sweeps the cylindrical side wall 29 of the portion of the chamber which houses male rotor 11, with a clearance of a few thousandths of an inch.

Female rotor 13 has one to three pockets 37 therein for the reception of lobes 27 of male rotor 11. If rotor 11 has one lobe 27, then rotor 13 will have one pocket 37; but if rotor 11 has two lobes 27, then rotor 13 can have two pockets 37 as shown, or even three pockets 37. As is well known in the design of rotary compressors, if the number of lobes 27 and pockets 37 is the same, then the pitch circles of the respective rotors will be of equal diameter; but if the number of lobes 27 and pockets 37 is unequal, then the pitch circles will vary according to known proportions. For example: if there are two lobes 27 and three pockets 37, then the pitch circle of female rotor 13 will be 50% greater than that of male rotor 11.

Figure 5:
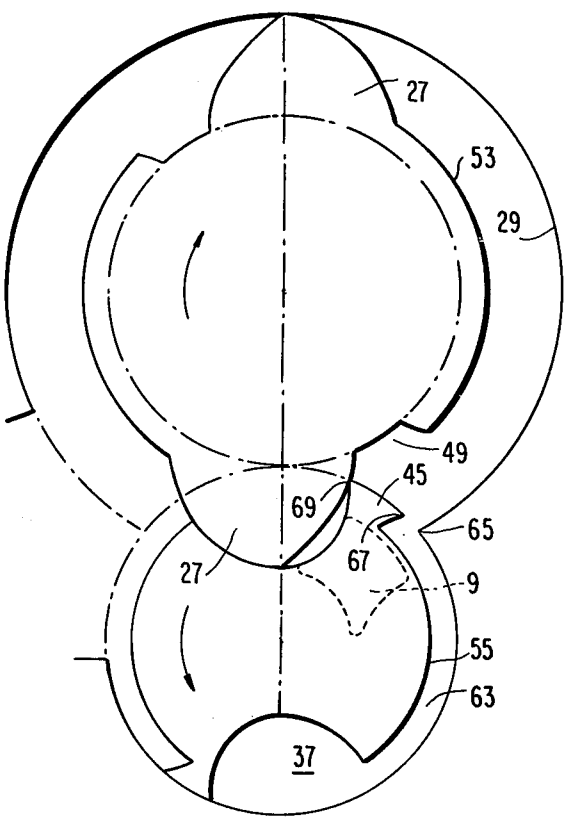
FIG. 5 is a view similar to FIGS. 3 and 4, but at the end of the discharge cycle.

Each pocket 37 has a concave leading side 39 and a concave trailing side 41 which intersect along a trough 43 at the deepest part of the pocket 37, these troughs 43 and the crests 35 of the lobes 27 lying in a common plane that includes the rotor axes in the position of the parts shown in FIG. 1, which is also the position of the parts at the end of the discharge cycle as shown in simplified form in FIG. 5.

Immediately behind trailing side 41 of each pocket 37 of female rotor 13 is a sealing rib 45 whose outer periphery is part cylindrical and spaced with only slight clearance from the cylindrical side wall 47 of the portion of casing 1 occupied by female rotor 13.

Each rib 45 is bounded on its leading flank by the radially outermost portion of trailing side 41 of pocket 37. Each rib 45 has a peripheral extent which is only a fraction of that of pocket 37.

Each rib 45 is received in a recess 49 in male rotor 11. Each recess 49 is bounded on its forward side by the radially innermost portion of trailing side 33 of a lobe 27. In the embodiment illustrated in FIG. 1, the bottom of each recess 49 is part-cylindrical and lies on the pitch circle of male rotor 11. Similarly, the part-cylindrical outer surface of each rib 45 lies on the pitch circle of female rotor 13, the intersection of these two pitch circles being shown in FIG. 1 at 51. It follows, therefore, that the bottom of recess 49 and the outer surface of rib 45 subtend the same angle relative to the axes of their respective rotors, in the embodiment of FIG. 1.

The male rotor 11, between each recess 49 and the next rearward lobe 27, is outwardly bounded by a part-cylindrical periphery 53 which lies outside but is concentric with the pitch circle of the male rotor. Similarly, the female rotor 13, between each rib 45 and the next rearward pocket 37, is outwardly bounded by a part-cylindrical periphery 55; but periphery 55 of female rotor 13, in contrast to periphery 53 of male rotor 11, although it is concentric with the pitch circle of female rotor 13, nevertheless lies inside that pitch circle. The sum of the radii of peripheries 53 and 55 is almost but not quite equal to the interaxial distance of rotors 11 and 13, so that peripheries 53 and 55 are spaced apart by only a small clearance when juxtaposed, e.g. in their FIG. 4 position.

The purpose of ribs 45 is primarily to seal between the compression and the suction sides of female rotor 13 and secondarily to augment the compression of gas by lobes 27. For this purpose, ribs 45 should have only that peripheral extent necessary to perform this sealing function and at the same time to have sufficient strength to perform their secondary compression function. In other words, ribs 45 should have the smallest possible peripheral extent consistent with good design; and to this end, the peripheral extent of each part-cylindrical periphery 55 of rotor 13 should be several times, for example at least four times greater than the peripheral extent of rib 45.

Correspondingly, the peripheral extent of each recess 49 will be only that which is necessary to receive its associated rib 45, with the result that the peripheral extent of the associated part-cylindrical periphery 53 will be several times greater than that of recess 49.

The fact that the cylindrical peripheries 53 and 55 of the rotors are spaced inwardly from their respective casing side walls 29 and 47, means that, as is usual, there is a suction space 57 on the inlet side of male rotor 11 and a compression space 59 on the outlet side thereof. But more importantly to the present invention, the fact that the cylindrical peripheries 55 of female rotor 13 are spaced inwardly from the cylindrical side wall 47 of the chamber, means that there will be a suction space 61 on the inlet side of female rotor 13 and a compression space 63 on the outlet side thereof. That compression space 63 extends from the associated pocket 37 with which it communicates, up to the edge 65 that marks the boundary between the cylindrical side walls 29 and 47 associated with the male rotor 11 and the female rotor 13, respectively.

It is particularly to be noted, and this is a very important feature of the present invention, that the compression spaces 59 and 63 communicate with each other as soon as the trailing edge 67 of rib 45 clears edge 65 of casing 1. As is evident from FIG. 3, this clearance takes place at the very start of the compression cycle. Prior to this clearance, that is, prior to the time that compression spaces 59 and 63 communicate with each other, no substantial compression takes place. As a result, at the time when trailing edge 67 of rib 45 clears edge 65 of casing 1, the pressure in spaces 59 and 63 is equal. Moreover, throughout compression, those pressures, although rapidly rising, remain equal to each other, because the spaces 59 and 63 remain in communication with each other throughout the compression cycle up to and beyond the start of the discharge cycle, as shown in FIG. 4.

This very important communication between the compression sides of the male and female rotors throughout at least all of the compression cycle, is the result of making ribs 45 peripherally very short, which is to say providing part-cylindrical peripheries 55 spaced inwardly from cylindrical side wall 47, which is also to say that periphery 55 is of much greater peripheral extent than rib 45.

The result of this very important feature, is that the pocket 37 which is approaching outlet port 9, remains in communication with the compression space 59 of the male rotor throughout compression and so no work is lost due to the equalization of pressures between 37 and 59. In the prior art, 37 and 59 did not communicate in this manner, with the result that the pressure in 59 rose during compression to a value substantially higher than the pressure in 37. When 37 and 59 ultimately came into communication, then the gas in 59 would expand abruptly into 37, thereby dropping the pressure in 59, which resulted in a loss of the work already done to compress the gas.

Figure 4:
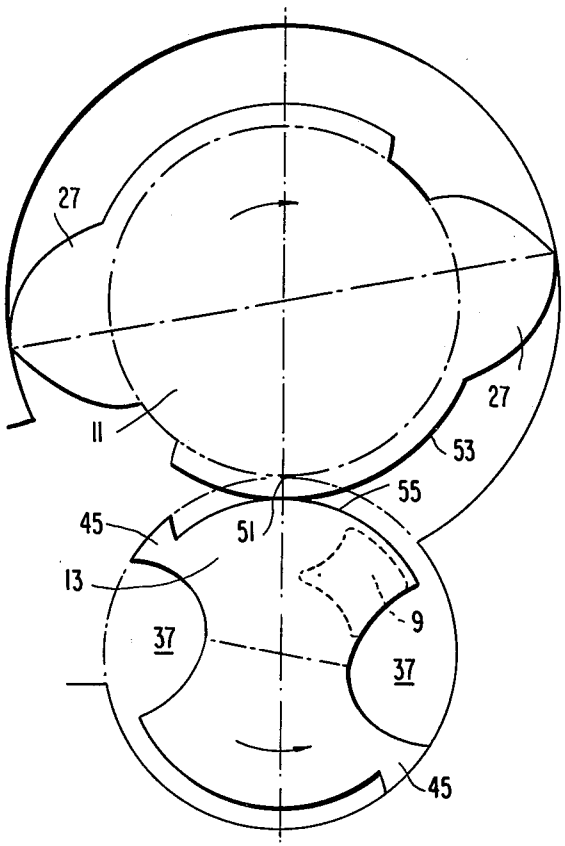
FIG. 4 is a view similar to FIG. 3 but at the start of the discharge cycle.
Figure 3:
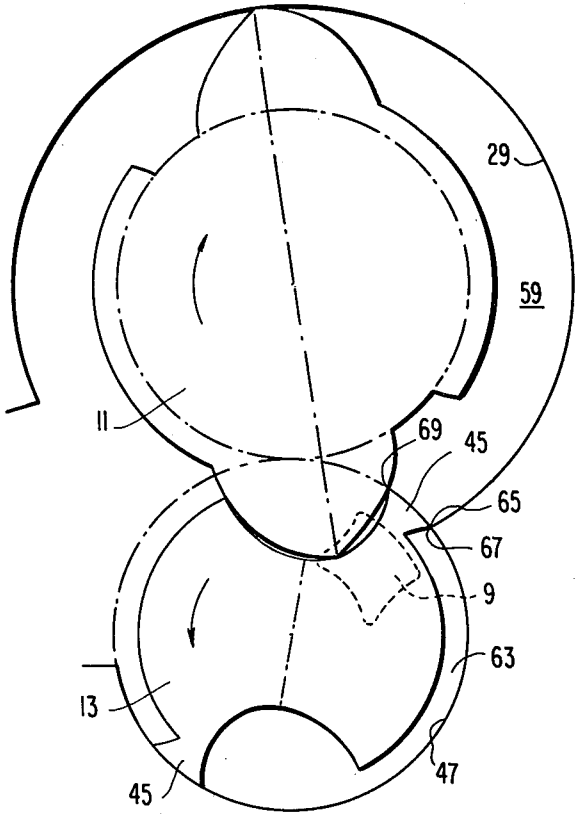
FIG. 3 is a simplified view of the rotors at the start of the compression cycle.

The operation of the rotary compressor of the present invention will now be clear from a comparison of FIGS. 3, 4 and 5. As is seen in FIG. 3, at the start of the compression cycle, the leading edge 69 of rib 45 is in close adjacency with trailing side 33 of the adjacent lobe 27, thereby sealing compression space 59 from outlet ports 9. At the same time, edges 65 and 67, on casing 1 and rib 45, respectively, separate from each other, thereby placing compression spaces 59 and 63 in communication with each other. Upon further rotation of the rotors in the directions of their respective arrows, compression spaces 59 and 63 are both reduced in volume, thereby increasing the pressure of the gas.

When pocket 37 begins to expose outlet port 9, however, the discharge cycle begins. The start of the discharge cycle is shown in FIG. 4, in which leading surface 39 of pocket 37 is in registry with one of the margins of outlet ports 9. As outlet ports 9 are progressively opened, the compressed gas in compression spaces 59 and 63 exits through ports 9 until the trailing side 41 of pocket 37 registers with the opposite margins of outlet ports 9, that is, when the solid portion of the female rotor 13 to the rear of trailing side 41 of pocket 37 closes outlet ports 9. At about this same time, however, as will be seen from FIG. 5, the trailing edge 67 of a rib 45 has moved a substantial distance away from edge 65 of casing 1, which means that at the end of the discharge cycle, another compression cycle is already under way. In other words, the discharge and compression cycles slightly overlap.

Figure 7:
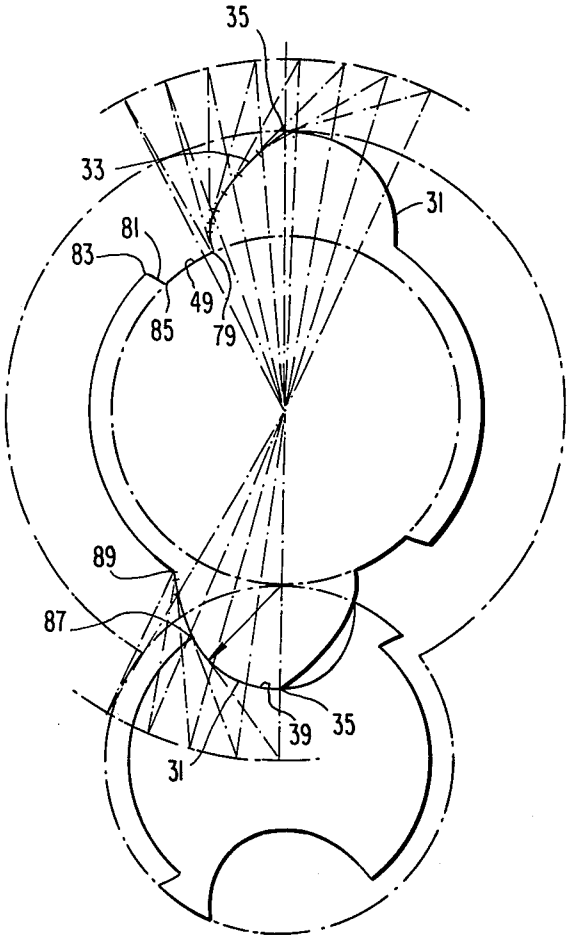
FIG. 7 is a diagrammatic representation of the tooth generation for the male rotor.
Figure 6:
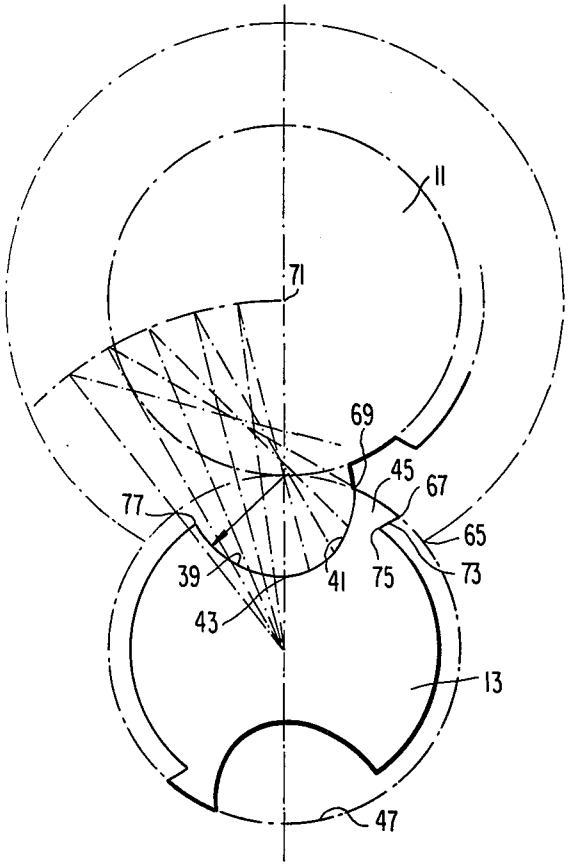
FIG. 6 is a diagrammatic representation of the tooth space generation for the female rotor.

The generation of the rotor surfaces which make possible the above operation, is shown in FIGS. 6 and 7. Considering first FIG. 6, the generation of the surfaces of the female rotor 13 of the embodiment of FIG. 1 is shown. As is evident from FIG. 6, the curve of trailing side 41 of pocket 37, from trough 43 to leading edge 69 of rib 45, is generated by an arm having a radius equal to the distance from trough 43 to axis 71 of male rotor 11, the generating circle of which this radius forms a part having a base circle of the same diameter as the pitch diameter of the male rotor. This configuration of trailing side 41 of pocket 37 is known in the art and so forms no part of the present invention.

The profile of trailing flank 73 of rib 45, from trailing edge 67 of rib 45 to the base 75 of rib 45, is also identical to the corresponding part of the curve from 43 to 69.

Leading side 39 of pocket 37 is part-cylindrical about an axis represented by the point of intersection 51 of the pitch circles of the two rotors when the parts are in the position of FIGS. 1, 5 and 6. Thus, the shape of the curve from trough 73 to edge 77 of pocket 37 is conventional; but the termination of this curve at edge 77, within the pitch circle of the female rotor and spaced a substantial distance radially inwardly from cylindrical side wall 47, is novel.

Turning now to FIG. 7, there is shown the tooth generation for the male rotor 11. The curve of trailing side 33 from base 79 of lobe 27 to crest 35, is the addendum of a cycloidal gear tooth having a generating circle equal to the pitch diameter of the female rotor. This curve, however, is known in the art and so forms no part of the present invention.

The trailing flank 81 of recess 49, from the outer edge 83 to the base 85 thereof, is also identical to the corresponding part of the curve from 79 to 35.

The leading side 31 of lobe 27 has a cylindrical curvature from crest 35 over most of side 31 to point 87. Point 87 is seen in FIG. 7 to be the point of coincidence of side 33 with edge 77 when the parts are in the FIG. 7 position. This portion of side 31, from crest 35 to point 87, has the same radius as and is concentric with side 39 of pocket 37 in the FIG. 7 position of the parts. The cylindrical curvature of side 31 of lobe 27, between crest 35 and point 87, is known in the art and so forms no part of the present invention.

The shape of the remainder of side 31, from point 87 to base 89, is novel. It is generated by the edge 77 of the female rotor as the female rotor rolls clockwise about the male rotor as seen in FIG. 7, pitch circle to pitch circle, as indicated graphically in FIG. 7.

Figure 8:
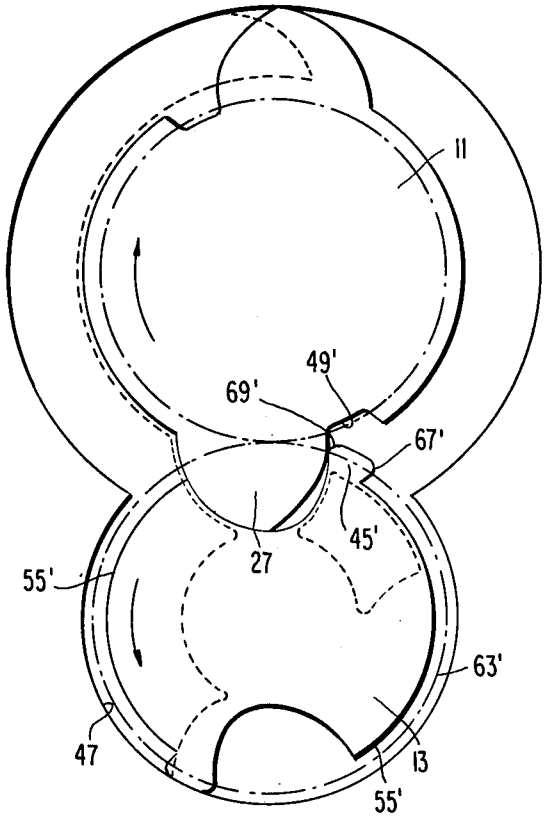
FIG. 8 is a view similar to FIG. 5 but showing a modified rotor configuration.

Turning now to FIG. 8, there is shown a slightly modified embodiment of the present invention, in which the ribs 45′ and recesses 49′ have a somewhat different configuration than in the preceding embodiment. Specifically, the leading and trailing edges 69′ and 67′, respectively, of the ribs 45′ are rounded in order to avoid having very sharp sealing edges at these points. The corners of recesses 49′ are of course correspondingly rounded.

The provision of rounded leading and trailing edges 69′ and 67′ on rib 45′ results in a configuration of rib 45′ whose outer surface is disposed outside the pitch circle of female rotor 13. Similarly, the bottom of recess 49′ is disposed inside the pitch circle of male rotor 11. This increase in height of rib 45′, compared to the preceding embodiment, also increases the volume of compression space 63′ associated with the female rotor, because the part-cylindrical peripheries 55′ of the female rotor of FIG. 8 are of smaller radius than those in the preceding embodiment, in order to accommodate the increased height of ribs 45′ within the same cylindrical side wall 47.

From a consideration of the foregoing disclosure, therefore, it will be evident that the initially recited objects of the present invention have been achieved.

Although the present invention has been described and illustrated in connection with preferred embodiments, it is to be understood that modifications and variations may be resorted to without departing from the spirit of the invention, as those skilled in this art will readily understand. Such modifications and variations are considered to be within the purview and scope of the present invention as defined by the appended claims.

What is claimed is:

1. In a rotary compressor comprising a casing having an inlet for gas to be compressed, an outlet for compressed gas, a chamber communicating between the inlet and outlet, and in the chamber a female rotor and a male rotor that turn in opposite directions, the chamber having cylindrical side walls concentric with the rotors, the female rotor having at least one pocket therein that receives at least one lobe on the male rotor, the lobe sweeping one of said cylindrical side walls; the improvement comprising a sealing rib on the female rotor on the trailing side of each said at least one pocket, a recess on the male rotor at the rear of each said at least one lobe for receiving the rib, the female rotor having a peripheral surface extending rearwardly from the rib with respect to the direction of rotation of the female rotor, and terminating in a said pocket, said peripheral surface being spaced a substantial distance radially inwardly of the other of said cylindrical side walls of the casing, the rib sweeping said other side wall, said at least one pocket intermittently registering with said outlet upon rotation of said female rotor, said outlet communicating with said chamber and being open for the outflow of compressed gas only when in registry with said at least one pocket and being closed by said female rotor to the outflow of gas when out of registry with said at least one pocket, said cylindrical side walls meeting at an edge, said rib clearing said edge at the start of a compression cycle of said compressor.

2. In a rotary compressor comprising a casing having an inlet for gas to be compressed, an outlet for compressed gas, a chamber communicating between the inlet and outlet, and in the chamber a female rotor and a male rotor that turn in opposite directions, the chamber having cylindrical side walls concentric with the rotors, the female rotor having at least one pocket therein that receives at least one lobe on the male rotor, the lobe sweeping one of said cylindrical side walls; the improvement comprising a sealing rib on the female rotor on the trailing side of each said at least one pocket, a recess on the male rotor at the rear of each said at least one lobe for receiving the rib, the female rotor having a peripheral surface extending rearwardly from the rib with respect to the direction of rotation of the female rotor, and terminating in a said pocket, said peripheral surface being spaced a substantial distance radially inwardly of the other of said cylindrical side walls of the casing, the rib sweeping said other side wall, said at least one pocket intermittently registering with said outlet upon rotation of said female rotor, said outlet communicating with said chamber and being open for the outflow of compressed gas only when in registry with said at least one pocket and being closed by said female rotor to the outflow of gas when out of registry with said at least one pocket, said lobe having a leading side that is generated by the leading edge of said pocket from the radially inner edge of said leading side to the location of said leading edge when the crest of said lobe lies in the plane common to the axes of the rotors.

3. In a rotary compressor comprising a casing having an inlet for gas to be compressed, an outlet for compressed gas, a chamber communciating between the inlet and outlet, and in the chamber a female rotor and a male rotor that turn in opposite directions, the chamber having cylindrical side walls concentric with the rotors, the female rotor having at least one pocket therein that receives at least one lobe on the male rotor, the lobe sweeping one of said cylindrical side walls; the improvement comprising a sealing rib on the female rotor on the trailing side of each said at least one pocket, a recess on the male rotor at the rear of each said at least one lobe for receiving the rib, the female rotor having a peripheral surface extending rearwardly from the rib with respect to the direction of rotation of the female rotor, and terminating in a said pocket, said peripheral surface being spaced a substantial distance radially inwardly of the other of said cylindrical side walls of the casing, the rib sweeping said other side wall, said at least one pocket intermittently registering with said outlet upon rotation of said female rotor, said outlet communicating with said chamber and being open for the outflow of compressed gas only when in registry with said at least one pocket and being closed by said female rotor to the outflow of gas when out of registry with said at least one pocket, said lobe having a leading side that is generated by the leading edge of said pocket from the radially inner edge of said leading side to the location of said leading edge when the crest of said lobe lies in the plane common to the axes of the rotors, the entire leading side of said pocket being concave.

* * * * *